US006314842B1

(12) United States Patent
Hsieh

(10) Patent No.: US 6,314,842 B1
(45) Date of Patent: Nov. 13, 2001

(54) CRESCENT WRENCH

(76) Inventor: Chih-Ching Hsieh, No. 64, Lane 107, Liang Tsun Rd., Fong Yuan City, Taichung Hsien (TW)

( * ) Notice: Subject to any disclaimer, the term of this patent is extended or adjusted under 35 U.S.C. 154(b) by 0 days.

(21) Appl. No.: 09/562,772

(22) Filed: May 2, 2000

(51) Int. Cl.[7] ..... B25B 13/16

(52) U.S. Cl. ..... 81/170; 81/129; 81/155; 81/165; 81/166

(58) Field of Search ..... 81/129, 155, 165, 81/170, 166

(56) References Cited

U.S. PATENT DOCUMENTS 5,222,419 * 6/1993 Spector .
5,540,125 * 7/1996 Haskell .

* cited by examiner

*Primary Examiner*—Timothy V. Eley
*Assistant Examiner*—Willie Berry, Jr.
(74) *Attorney, Agent, or Firm*—Varndell & Varndell, PLLC

(57) ABSTRACT

A crescent wrench having a screw hole at its handle in front of a thumbscrew, a holding-down screw threaded into the screw hole, and a handle couped to the holding-down screw and adapted for turning the holding-down screw between the operative position to hold down a movable jaw, which is to be turned by the thumbscrew relative to a fixed jaw at one end of the handle, and the non-operative position to release the movable jaw.

2 Claims, 4 Drawing Sheets

CRESCENT WRENCH

BACKGROUND AND SUMMARY OF THE INVENTION

The present invention relates to a crescent wrench, and more particularly to such a crescent wrench which comprises a holding-down screw turned by handle to releasably hold down the movable jaw in the desired position.

A regular crescent wrench is generally comprised of a handle having one end terminating in a fixed jaw, a movable jaw coupled to the handle and moved relative to the fixed jaw, and a thumbscrew mounted in a hole in the handle and turned with the thumb to move the movable jaw relative to the fixed jaw. This structure of crescent wrench is not satisfactory in function because the movable jaw tends to be forced out of position during the operation of the crescent wrench. In order to stop the movable jaw in position, much pressure must be employed to the thumbscrew through the thumb.

The present invention has been accomplished to provide a crescent wrench which eliminates the aforesaid problem. According to the present invention, a holding-down screw is threaded into a screw hole in the handle of the crescent wrench in front of the thumbscrew, and a handle is provided for turning the holding-down screw in the screw hole by the thumb. When the holding-down screw is turned inwards, it is forced into engagement with the movable jaw to stop it from displacement. When the holding-down screw is turned outwards, it is disengaged from the movable jaw, permitting the movable jaw to be moved by the thumbscrew.

DETAILED DESCRIPTION OF THE PREFERRED EMBODIMENT

Figure 1:
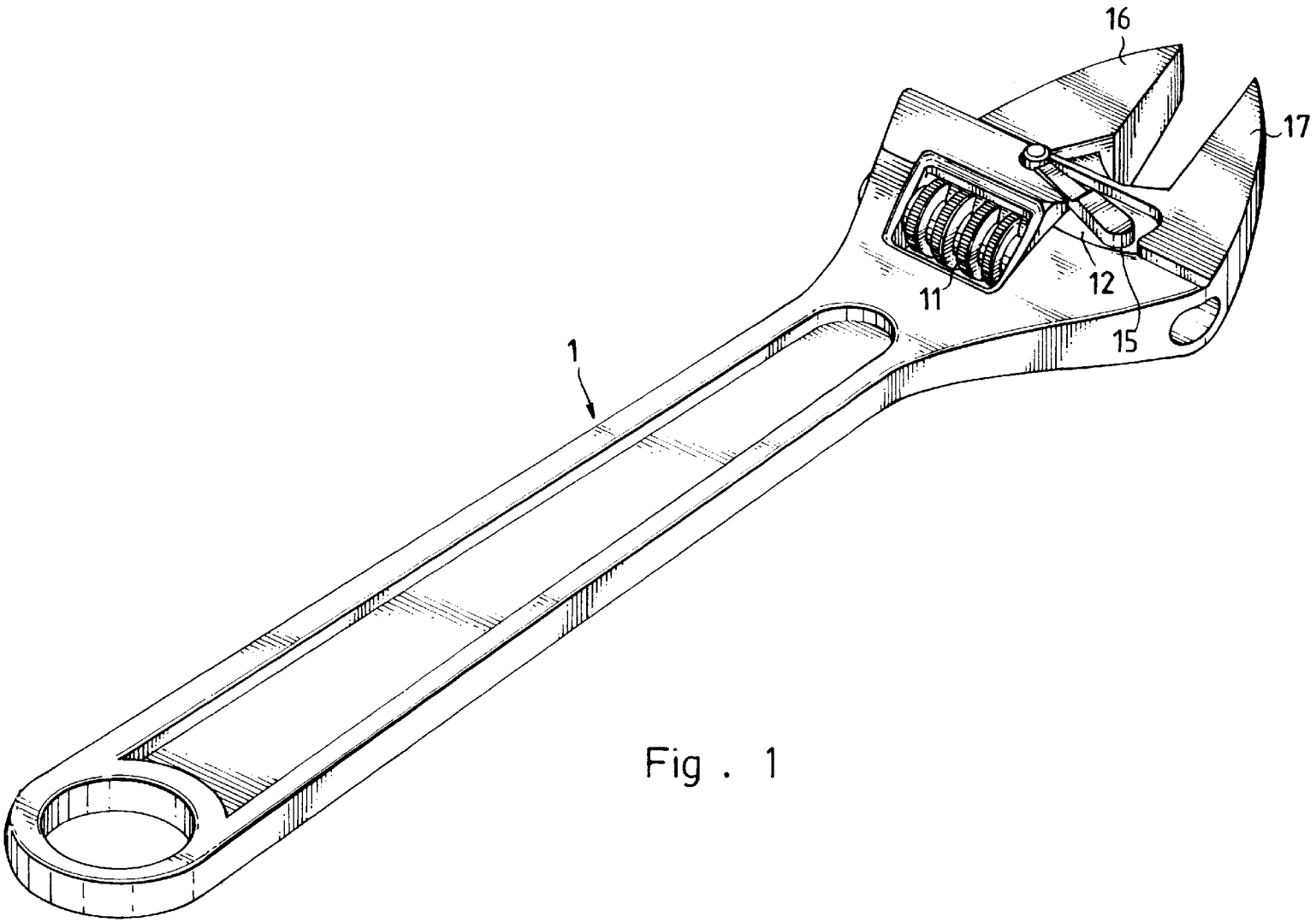
FIG. 1 is an elevational view of a crescent wrench according to the present invention.
Figure 2:
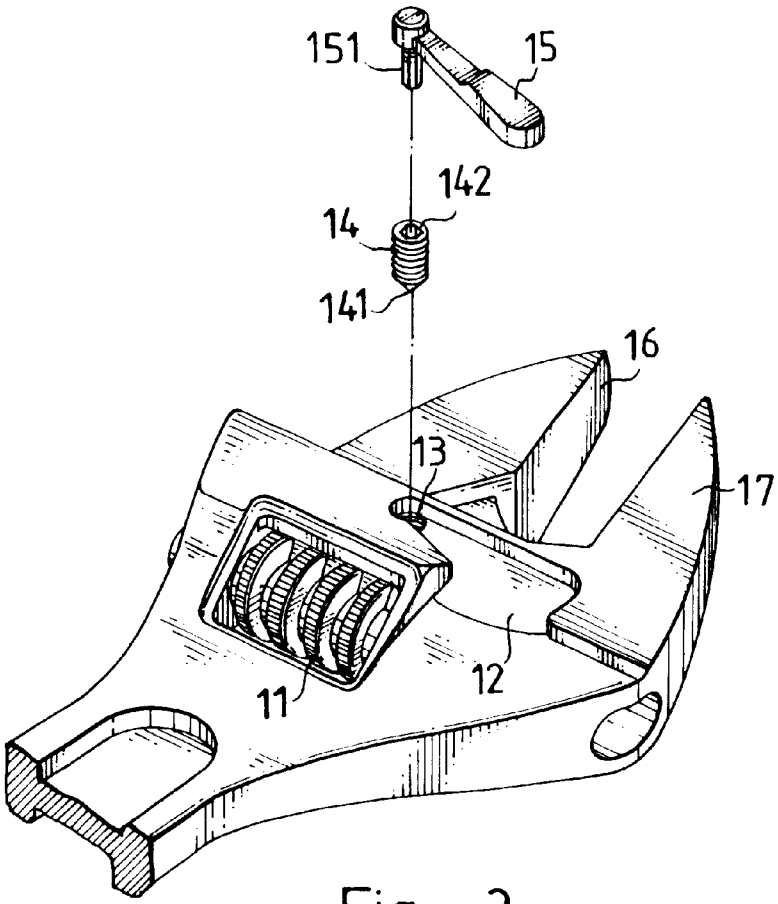
FIG. 2 is an exploded view of the crescent wrench shown in FIG. 1.

Referring to FIGS. 1 and 2, a crescent wrench 1 in accordance with the Present invention comprises a handle with a fixed jaw 17, a movable jaw 16 moved relative to the fixed jaw 17, a thumbscrew 11 turned to move the movable jaw 16 relative to the fixed jaw 17. The crescent wrench 1 further comprises a recess 12 disposed between the thumbscrew 11 and the fixed jaw 17, a left-handed screw hole 13 at one end of the recess 12, a screw rod 14 mounted in the left-handed screw hole 13 and having a conical tip 141 at its bottom end and a polygonal coupling hole 142 at its top end, and a handle 15 having a polygonal driving rod 151 at one end fitted into the polygonal coupling hole 142 of the screw rod 14.

Figure 3:
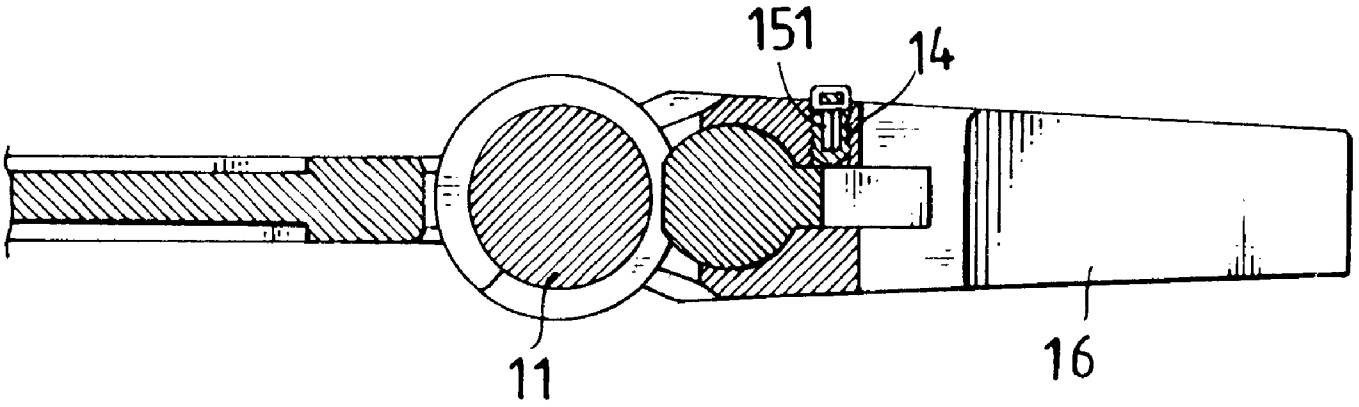
FIG. 3 is a side view in section of the crescent wrench shown in FIG. 1.
Figure 4:
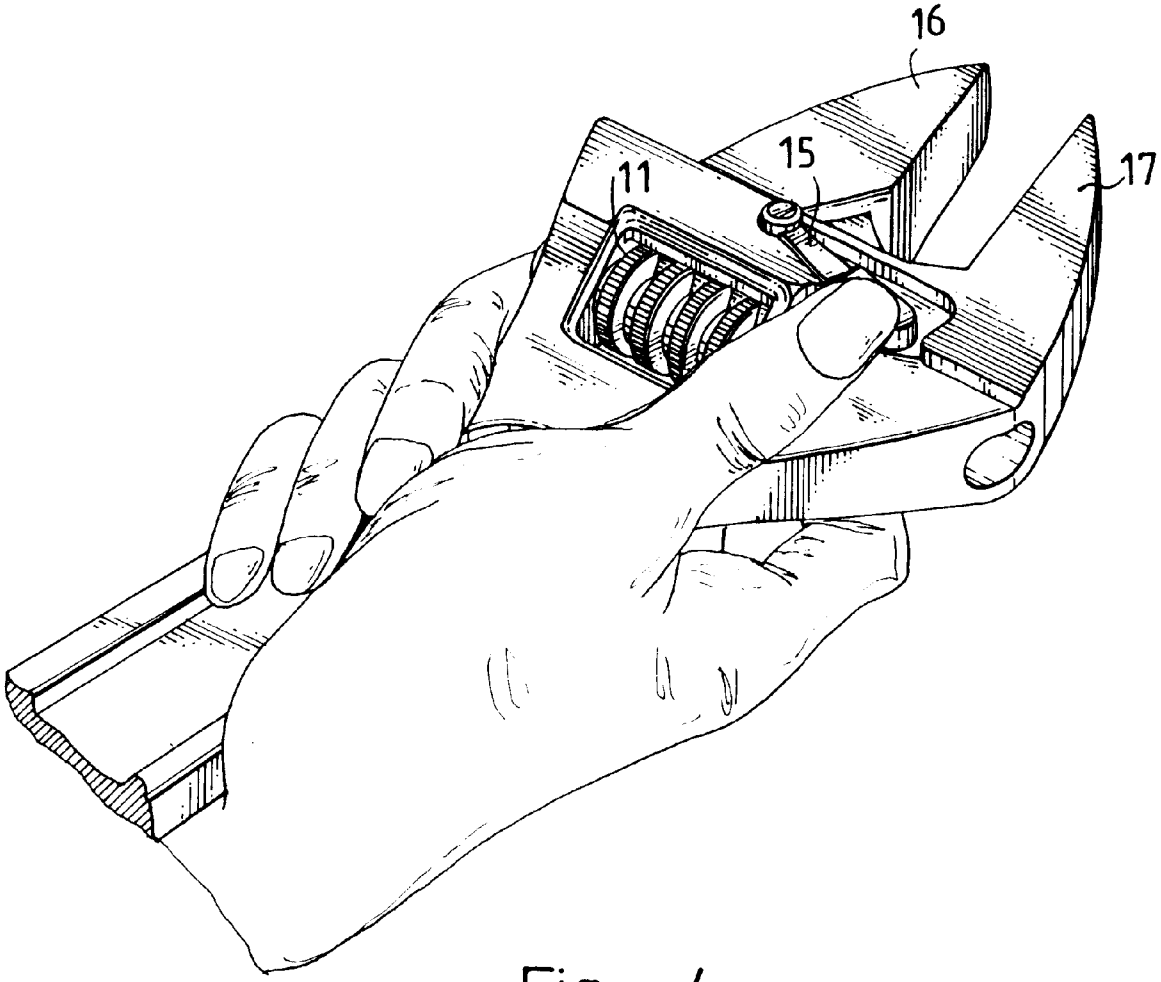
FIG. 4 is an applied view of the present invention, showing the handle pulled backwards.

Referring to FIGS. 3 and 4, when the handle 15 is pushed forwards, the screw rod 14 is threaded into the left-handed screw hole 13 to force its conical tip 141 into engagement with the movable jaw 16, and therefore the movable jaw 16 is held down. On the contrary, when the handle 15 is pulled backwards, the screw rod 14 is turned out of the left-handed screw hole 13 to disengage its conical tip 141 from the movable jaw 16, permitting the movable jaw 16 to be moved relative to the fixed jaw 17 by the thumbscrew 11.

While only one embodiment of the present invention has been shown and described, it will be understood that various modifications and changes could be made thereunto without departing from the spirit and scope of the invention disclosed.

What is claimed is:

1. A crescent wrench comprising handle having one end terminating in a fixed jaw, a movable jaw coupled to said handle and moved relative to said fixed jaw, and a thumbscrew mounted in a hole in said handle and turned to move said movable jaw relative to said fixed jaw, wherein said handle comprises a recess disposed at one side between said thumbscrew and said fixed jaw, a screw hole at said recess, a holding-down screw threaded into said screw hole and turned to hold down said movable jaw, said holding-down screw having a bottom end terminating in a conical tip and a top end made with a polygonal coupling hole, and a handle adapted for turning said holding-down screw in said screw hole, said handle having a polygonal driving rod fitted into the polygonal coupling hole of said holding-down screw.

2. The crescent wrench of claim 1 wherein said screw hole is a left-handed screw hole.

* * * * *